US010000968B2

(12) United States Patent
Bodet et al.

(10) Patent No.: US 10,000,968 B2
(45) Date of Patent: Jun. 19, 2018

(54) ELECTROMECHANICAL ACTUATOR AND HOME AUTOMATION INSTALLATION COMPRISING SUCH AN ELECTROMECHANICAL ACTUATOR

(71) Applicant: SOMFY SAS, Cluses (FR)

(72) Inventors: Florian Bodet, La Roche sur Foron (FR); Beatrice Ducornetz, Thyez (FR); Fabrizio Girola, Viuz-en-Sallaz (FR)

(73) Assignee: SOMFY SAS, Cluses (FR)

( * ) Notice: Subject to any disclaimer, the term of this patent is extended or adjusted under 35 U.S.C. 154(b) by 0 days. days.

(21) Appl. No.: 15/323,763

(22) PCT Filed: Jul. 9, 2015

(86) PCT No.: PCT/EP2015/065704

§ 371 (c)(1),
(2) Date: Jan. 4, 2017

(87) PCT Pub. No.: WO2016/005497

PCT Pub. Date: Jan. 14, 2016

(65) Prior Publication Data

US 2017/0167191 A1 Jun. 15, 2017

(30) Foreign Application Priority Data

Jul. 9, 2014 (FR) ..... 14 56621

(51) Int. Cl.
*E06B 9/72* (2006.01)
*H01R 13/627* (2006.01)
(Continued)

(52) U.S. Cl.
CPC ..... *E06B 9/72* (2013.01); *E06B 9/40* (2013.01); *E06B 9/70* (2013.01); *H01R 13/5219* (2013.01); *H01R 13/6272* (2013.01)

(58) Field of Classification Search
CPC ..... E06B 9/72; E06B 9/40; E06B 9/70; H01R 13/5219; H01R 13/741
(Continued)

(56) References Cited

U.S. PATENT DOCUMENTS 3,639,950 A * 2/1972 Lutz ..... F16B 7/00 24/615
4,245,879 A * 1/1981 Buck ..... H01R 13/627 439/345
(Continued)

FOREIGN PATENT DOCUMENTS

CN 1863979 A 11/2006
EP 1 207 266 A2 5/2002
(Continued)

OTHER PUBLICATIONS

International Search Report, dated Oct. 20, 2015, from corresponding PCT Application.
(Continued)

*Primary Examiner* — Blair M Johnson
(74) *Attorney, Agent, or Firm* — Young & Thompson

(57) ABSTRACT

An electromechanical actuator (11) includes a sealing element (21) provided with a housing (22), an electronic control unit (15) electrically connected to a first electrical connector (23), and a power supply cable (18) including, at one of the ends of same, a second electrical connector (24). The second connector (24) includes an elastic tab (26) provided with a stop element (27) cooperating with a recess (28) provided in the housing (22), and a first bending area (32) provided at the junction between a first end (26*a*) of the elastic tab (26) and a body (25) of the second connector (24). The stop element (27) is provided at a second free end (26*b*) of the elastic tab (26). The elastic tab (26) includes a second
(Continued)

bending area (33) provided at the junction between an arm (37) and the stop element (27) of the elastic tab (26).

11 Claims, 7 Drawing Sheets

(51) Int. Cl.
*E06B 9/40* (2006.01)
*E06B 9/70* (2006.01)
*H01R 13/52* (2006.01)

(58) Field of Classification Search
USPC ..... 439/283, 293, 324, 296
See application file for complete search history.

(56) References Cited

U.S. PATENT DOCUMENTS 5,254,014 A * 10/1993 Yagi ..... H01R 13/6272 439/353
5,496,190 A * 3/1996 Ittah ..... H01R 13/6272 439/354
5,498,171 A * 3/1996 Semaan ..... H01R 13/641 439/352
5,993,237 A * 11/1999 Kern, Jr. ..... H01R 24/62 439/344
6,835,086 B1 * 12/2004 Tsai ..... H01R 13/6395 439/354

FOREIGN PATENT DOCUMENTS

EP 1331355 A1 7/2003
EP 1 443 172 A2 8/2004
EP 1939390 A2 7/2008

OTHER PUBLICATIONS

French Search Report, dated Mar. 3, 2015, from corresponding French Application.

* cited by examiner

ELECTROMECHANICAL ACTUATOR AND HOME AUTOMATION INSTALLATION COMPRISING SUCH AN ELECTROMECHANICAL ACTUATOR

BACKGROUND OF THE INVENTION

Field of the Invention

The present invention relates to an electromechanical actuator.

The present invention also relates to a home automation installation for closing or providing sun protection comprising a screen able to be wound on a winding tube rotated by one such electromechanical actuator.

In general, the present invention relates to the field of concealment devices comprising a motorized driving device setting a screen in motion between at least one first position and one second position.

Description of the Related Art

A motorized driving device comprises an electromechanical actuator for a movable element for closing, concealing or providing sun protection such as a shutter, door, gate, blind, or any other equivalent material, hereinafter referred to as a screen.

Document EP 1 443 172 A2 is already known, and describes an electromechanical actuator for a closure or sun protection home automation installation comprising a casing, an electric motor, an assembly support inserted inside one end of the casing, a torque reacting plate and a power cable.

The casing of the electromechanical actuator is supported by the torque reacting plate.

The assembly support comprises a housing inside which a first electrical connector is positioned.

The torque reacting plate comprises a passage opening for the power cable arranged opposite the housing of the assembly support inside which the first electrical connector is arranged.

The power cable comprises a second electrical connector at one of its ends. The second electrical connector cooperates with the first electrical connector, so as to supply the electric motor with electricity.

The second electrical connector comprises two elastic tabs. Each elastic tab comprises a stop element cooperating with the side walls of the opening of the torque reacting plate.

Each elastic tab comprises a first end, connected to a body of the second electrical connector, and a second free end protruding from the outer face of the torque reacting plate in the coupled position of the second electrical connector with the first electrical connector.

However, this electromechanical actuator has the drawback of arranging the stop element of the elastic tab of the second electrical connector near the first end of said elastic tab connected to the body of the second electrical connector.

Additionally, each elastic tab of the second electrical connector has a single flexure zone arranged at the junction between the first end of the elastic tab of the second electrical connector and the body of the second electrical connector.

Consequently, the separation of the second electrical connector from the first electrical connector is done by applying simultaneous pressure, using two of the user's fingers, on the second free end of each elastic tab of the second electrical connector.

The separation of the second electrical connector from the first electrical connector is thus done by bending each elastic tab at its flexure zone.

The keeping up of the second electrical connector relative to the first electrical connector is guaranteed by pressing the rear face of the stop element of each elastic tab of the second electrical connector against the side walls of the opening of the torque reacting plate when a pulling out force is exerted on the power cable or on the second electrical connector.

Consequently, the force exerted between the rear face of the stop element of each elastic tab of the second electrical connector against the side walls of the opening of the torque reacting plate is only along a direction parallel to a longitudinal axis passing through the second electrical connector.

Furthermore, such positioning of the stop element of the elastic tab of the second electrical connector may cause locking difficulties of the stop element of the elastic tab of the second electrical connector with the side walls of the opening of the torque reacting plate during coupling of the second electrical connector with the first electrical connector.

Consequently, the second electrical connector may be accidentally released from the first electrical connector when a pulling out force is exerted on the power cable or on the second electrical connector.

Moreover, the pressure exerted to separate the second electrical connector from the first electrical connector on the second free end of each elastic tab of the second electrical connector has a limited value, since it is provided to be implemented using two of the user's fingers.

BRIEF SUMMARY OF THE INVENTION

The present invention aims to resolve the aforementioned drawbacks and to propose an electromechanical actuator, as well as a closure or sun protection home automation installation comprising such an electromechanical actuator, making it possible to improve the resistance to pulling out of the electrical connectors and limit the accessibility of the free end of an elastic tab of a second electrical connector of a power cable.

To that end, according to a first aspect, the present invention relates to an electromechanical actuator for a closure or sun protection home automation installation comprising:

- a casing,
- an electric motor,
- a sealing element for one end of the casing,
- a power cable,
- an electronic control unit,
- where the electronic control unit is positioned inside the casing and electrically connected to a first electrical connector,
- where the sealing element comprises a housing, the first electrical connector being arranged opposite the housing of the sealing element or at least partially inside the housing of the sealing element,
- where the power cable comprises, at one of its ends, a second electrical connector, the second electrical connector cooperating with the first electrical connector, so as to supply the electric motor with electricity,
- where the second electrical connector comprises an elastic tab, said elastic tab comprising:

a stop element cooperating with a cavity arranged in the housing of the sealing element, a first end connected to a body of the second electrical connector, and a first flexure zone arranged at the junction between the first end of the elastic tab of the second electrical connector and the body of the second electrical connector.

According to the invention, the stop element of the elastic tab of the second electrical connector is arranged at a second free end of the elastic tab of the second electrical connector and the elastic tab of the second electrical connector comprises a second flexure zone arranged at the junction between an arm of the elastic tab of the second electrical connector and the stop element of the elastic tab of the second electrical connector.

Thus, the elastic tab of the second electrical connector has two flexure zones respectively arranged at the junction between the first end of the elastic tab of the second electrical connector and the body of the second electrical connector and at the junction between the arm of the elastic tab of the second electrical connector and the stop element of the elastic tab of the second electrical connector.

In this way, the elastic tab of the second electrical connector makes it possible to improve the keeping up of the first and second electrical connectors when a pulling out force is exerted on the power cable or on the second electrical connector. This is obtained through the elastic deformation of the elastic tab, in particular via the second flexure zone arranged at the junction between the arm of the elastic tab of the second electrical connector and the stop element of the elastic tab of the second electrical connector.

Furthermore, the positioning of the stop element of the elastic tab of the second electrical connector inside the housing of the sealing element makes it possible to limit the accessibility of the free end of the elastic tab of the second electrical connector belonging to the power cable, so as to avoid an accidental release of the second electrical connector relative to the first electrical connector.

Advantageously, the junction between the first end of the elastic tab of the second electrical connector and the body of the second electrical connector undergoes bending at the first flexure zone during the separation of the second electrical connector from the first electrical connector.

According to one preferred feature of the invention, the elastic tab of the second electrical connector is configured so that the bending at the first flexure zone, during the removal of the second electrical connector from the first electrical connector, is done using a tool.

Practically, the elastic tab of the second electrical connector has a bearing zone, so as to allow it to bend at the first flexure zone.

According to another preferred feature of the invention, the junction between the arm of the elastic tab of the second electrical connector and the stop element of the elastic tab of the second electrical connector undergoes bending at the second flexure zone during the application of a pulling out force on the power cable or on the second electrical connector.

According to another preferred feature of the invention, the free end of the elastic tab of the second electrical connector extends along a planar side wall of the body of the second electrical connector, so as to place the free end of the elastic tab of the second electrical connector bearing against the planar side wall of the body of the second electrical connector during application of a pulling out force on the power cable or on the second electrical connector.

Advantageously, the stop element of the elastic tab of the second electrical connector is harpoon-shaped.

According to another preferred feature of the invention, the second electrical connector comprises a single elastic tab.

Advantageously, the elastic tab of the second electrical connector is arc of circle-shaped.

According to a second aspect, the invention relates to a home automation installation for closing or providing sun protection that comprises a screen able to be wound on a winding tube rotated by an electromechanical actuator according to the invention.

This home automation installation has features and advantages similar to those previously described relative to the electromechanical actuator described above.

BRIEF DESCRIPTION OF THE DRAWINGS

Other particularities and advantages of the invention will also appear in the description below.

In the appended drawings, provided as non-limiting examples.

DETAILED DESCRIPTION OF THE PREFERRED EMBODIMENTS

Figure 1:
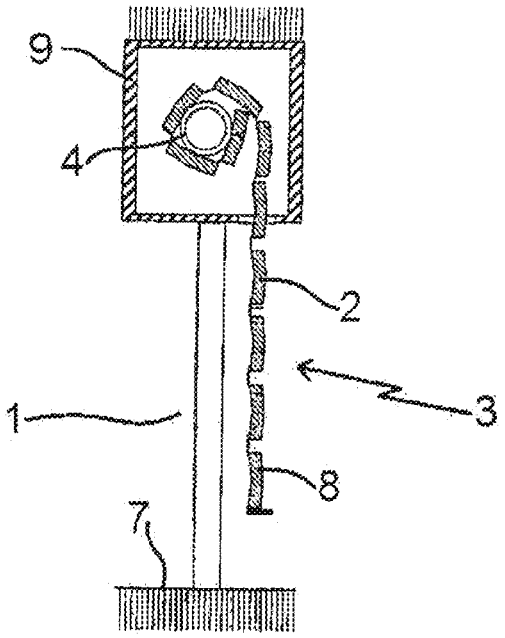
FIG. 1 is a sectional diagrammatic view of a home automation installation according to one embodiment of the invention.
Figure 2:
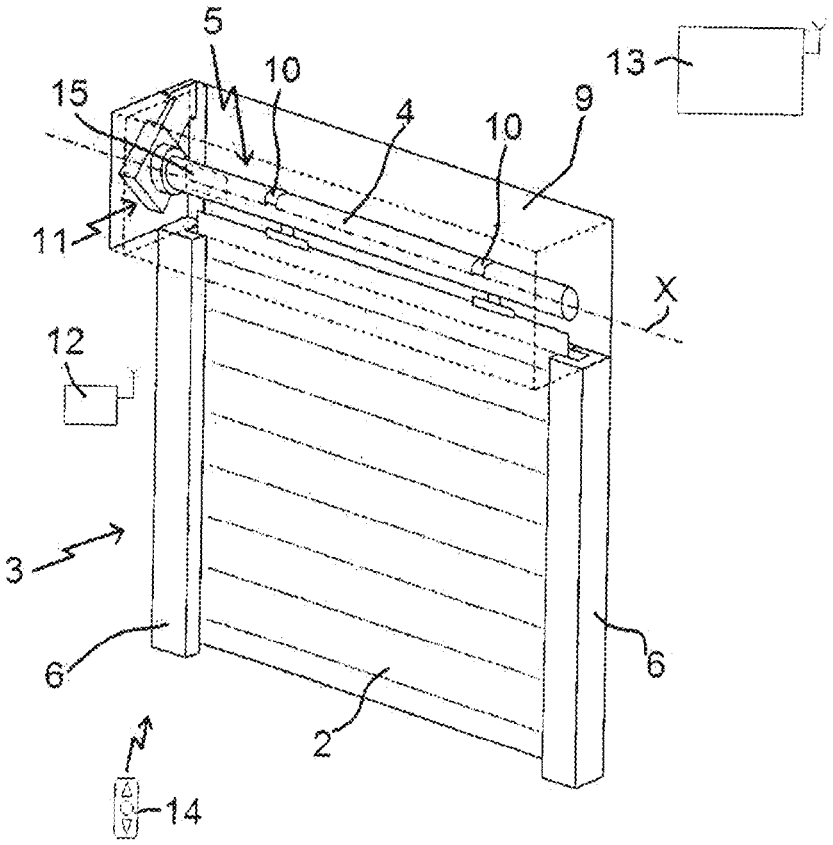
FIG. 2 is a diagrammatic perspective view of the home automation installation illustrated in FIG. 1.

In reference to FIGS. 1 and 2, we will first describe a home automation installation according to the invention and installed in a building comprising an opening 1, window or door, equipped with a screen 2 belonging to a concealing device 3, in particular a motorized rolling shutter.

The concealing device 3 can be a rolling shutter, a canvas blind or a blind with orientable slats, or a rolling gate. In practice, the present invention applies to all types of concealing devices.

A rolling shutter according to one embodiment of the invention will be described in reference to FIGS. 1 and 2.

The screen 2 of the concealing device 3 is wound on a winding tube 4 driven by a motorized driving mechanism 5 and movable between a wound position, in particular an upper position, and an unwound position, in particular a lower position.

The motorized driving mechanism 5 comprises an electromechanical actuator 11, in particular of the tubular type, making it possible to set the winding tube 4 in rotation so as to unwind or wind the screen 2 of the concealing device 3.

The concealing device 3 comprises the winding tube 4 for winding the screen 2, where, in the mounted state, the electromechanical actuator 11 is inserted into the winding tube 4.

The moving screen 2 of the concealing device 3 is a closing, concealing and/or sun protection screen, winding on the winding tube 4, the inner diameter of which is substantially equivalent to the outer diameter of the electromechanical actuator 11, such that the electromechanical actuator 11 can be inserted into the winding tube 4 during the assembly of the concealing device 3.

In a known manner, a rolling shutter 3 comprises an apron comprising horizontal slats articulated on one another, forming the screen 2 of the rolling shutter 3, and guided by two lateral guideways 6. These slats are joined when the apron 2 of the rolling shutter 3 reaches its unwound lower position.

In the case of a rolling shutter, the wound upper position corresponds to the bearing of a final L-shaped end slat 8 of the apron 2 of the rolling shutter 3 against an edge of a box 9 of the rolling shutter 3, and the unwound lower position corresponds to the bearing of the final end slat 8 of the apron 2 of the rolling shutter 3 against a threshold 7 of the opening 1.

The first slat of the rolling shutter 3, opposite the end slat, is connected to the winding tube 4 using at least one articulation 10.

The winding tube 4 is positioned inside the box 9 of the rolling shutter 3. The apron 2 of the rolling shutter 3 winds and unwinds around the rolling tube 4 and is housed at least partially inside the box 9.

The motorized driving mechanism 5 is commanded by a control unit. The control unit may for example be a local control unit 12, where the local control unit 12 can be connected through a wired or wireless connection with a central control unit 13. The central control unit 13 drives the local control unit 12, as well as other similar local control units distributed throughout the building.

The central control unit 13 can be in communication with a weather station located outside the building, in particular including one or more sensors that can be configured for example to determine a temperature, brightness, or wind speed.

A remote control 14, which can be a type of local control unit, and provided with a control keypad, which comprises selection and display means, further allows a user to intervene on the electromechanical actuator 11 and/or the central control unit 13.

The motorized driving mechanism 5 is preferably configured to carry out the unwinding or winding commands of the screen 2 of the concealing device 3, which may in particular be transmitted by the remote control 14.

The electromechanical actuator 11 comprises an electric motor 16. The electric motor 16 comprises a rotor and a stator positioned coaxially around an axis of rotation X.

Control means for controlling the electromechanical actuator 11 according to the invention, making it possible to move the screen 2 of the concealing device 3, are made up of at least one electronic control unit 15. This electronic control unit 15 is able to operate the electric motor 16 of the electromechanical actuator 11, and in particular to allow the supply of electricity for the electric motor 16.

Thus, the electronic control unit 15 in particular controls the electric motor 16, so as to open or close the screen 2, as previously described.

The electronic control unit 15 also comprises an order receiving module, in particular for radio orders sent by an order transmitter; such as the remote control 14 intended to control the electromechanical actuator 11.

The order receiving module can also allow the reception of orders sent by wired means.

Here, and as illustrated in FIG. 2, the electronic control unit 15 is positioned inside a casing 17 of the electromechanical actuator 11.

The control means of the electromechanical actuator 11 comprise hardware and/or software means.

As one non-limiting example, the hardware means may comprise at least one microcontroller.

Figure 3:
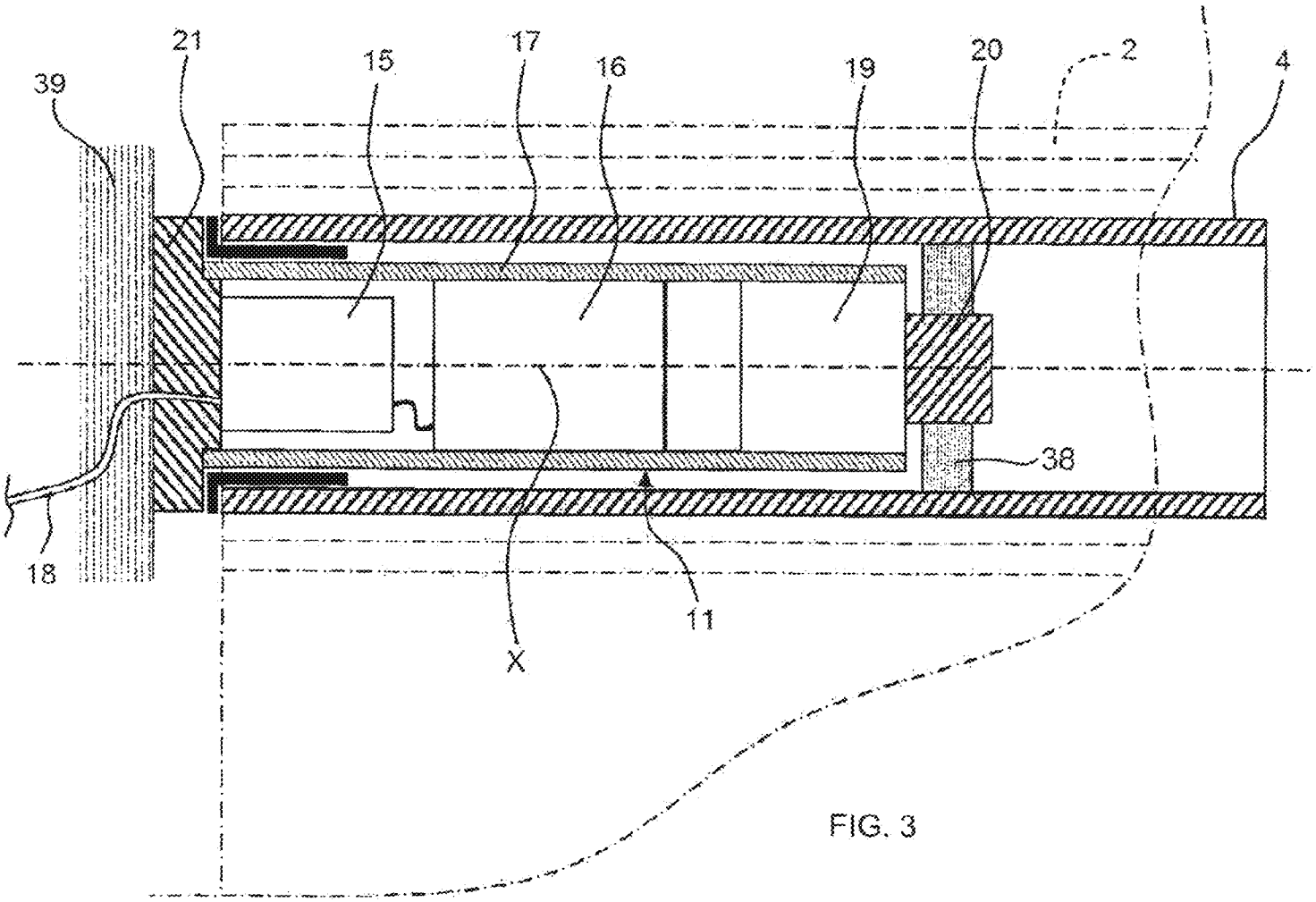
FIG. 3 is a diagrammatic partial sectional view of the home automation installation illustrated in FIG. 2 comprising an electromechanical actuator according to one embodiment of the invention.
Figure 4:
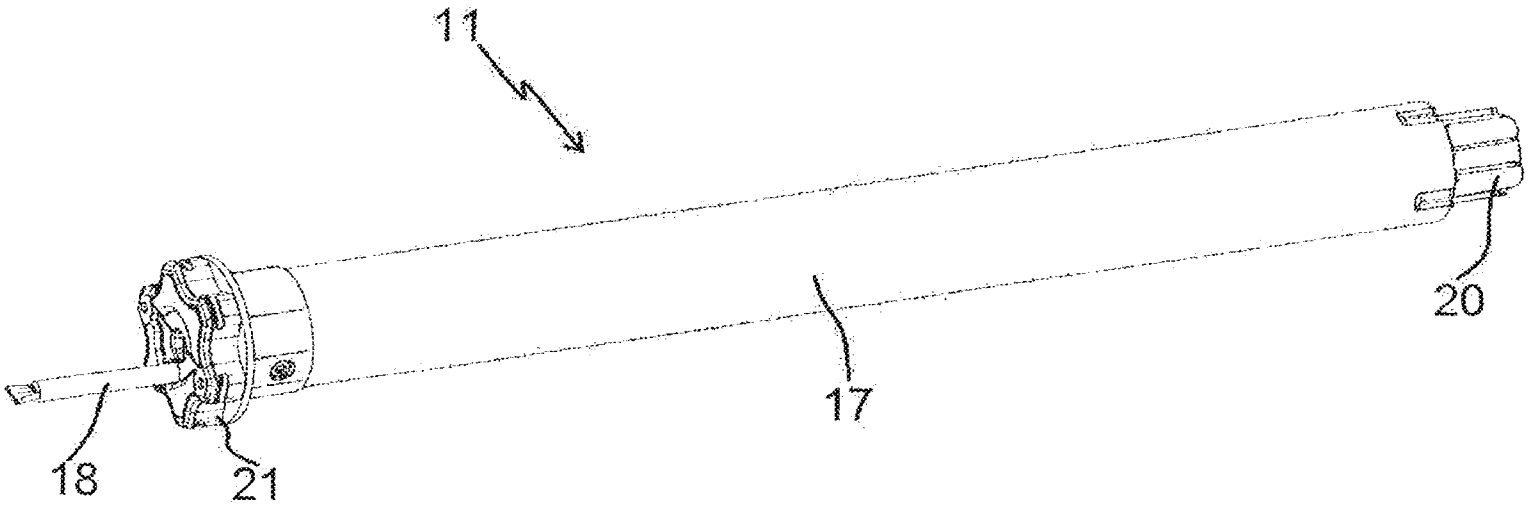
FIG. 4 is a diagrammatic perspective view of the electromechanical actuator of the home automation installation illustrated in FIGS. 1 to 3, where a power cable is connected to the electromechanical actuator.
Figure 5:
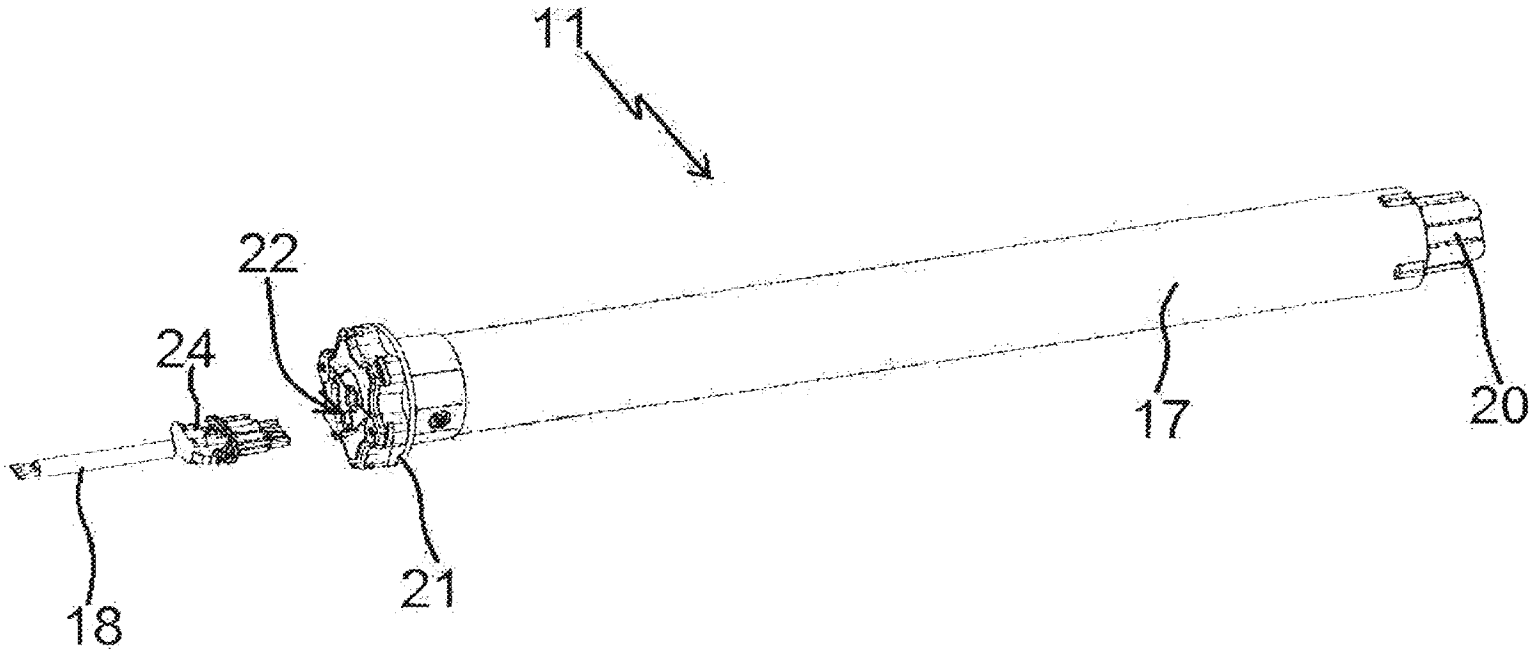
FIG. 5 is a view similar to FIG. 4, where the power cable is disconnected from the electromechanical actuator.
Figure 10:
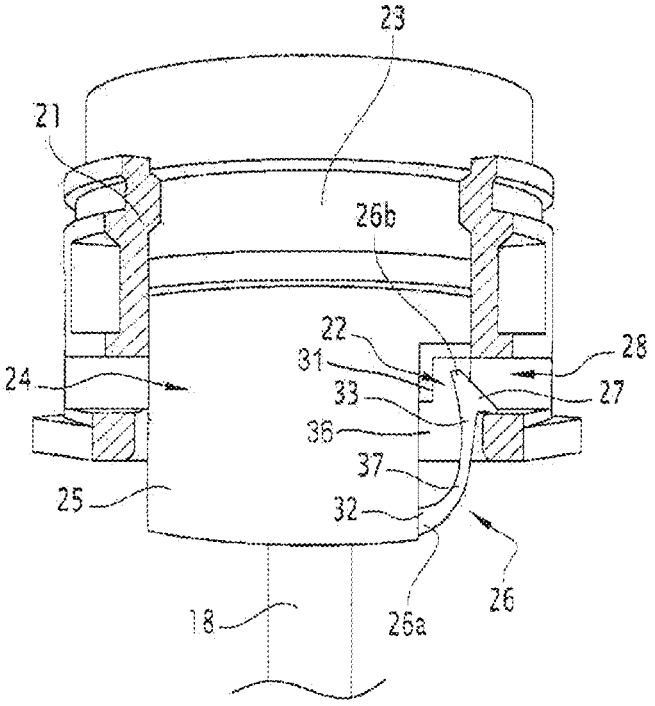
FIG. 10 is a diagrammatic view similar to FIG. 9 illustrating the case where the elastic tab of the second electrical connector is in a position for the keeping up of the second electrical connector relative to the first electrical connector when a pulling out force is exerted on the power cable or on the second electrical connector.

The electromechanical actuator 11 according to the invention and belonging to the home automation installation of FIGS. 1 and 2 will now be described in reference to FIGS. 3 and 10.

The electromechanical actuator 11 is supplied with electricity by an electricity grid of the sector. It makes it possible to move the screen 2 of the concealing device 3.

The electromechanical actuator 11 comprises a power cable 18 making it possible to supply electricity from the electricity grid of the sector.

The casing 17, which is preferably cylindrical, can be made from a metal material. The material of the casing of the electromechanical actuator is in no way limiting and may be different, and in particular made from plastic.

The electromechanical actuator 11 also comprises a reducing gear device 19 and an output shaft 20.

The electromechanical actuator 11 may also comprise an end-of-travel and/or obstacle detection device, which may be mechanical or electronic.

Advantageously, the electric motor 16 and the reducing gear device 19 are positioned inside the casing 17 of the electromechanical actuator 11.

The output shaft 20 of the electromechanical actuator 11 is positioned inside the winding tube 4, and at least partially outside the casing 17 of the electromechanical actuator 11.

The output shaft 20 of the electromechanical actuator 11 is coupled by a connecting means 38 to the winding tube 4, in particular using a wheel-shaped connecting means.

The electromechanical actuator 11 also comprises a sealing element 21 for one end of the casing 17.

Here, the casing 17 of the electromechanical actuator 11 is fastened to a support 39, in particular a flange, of a box of the concealing device 3 using the sealing element 21 forming a torque pin, in particular a closing off and torque-reacting head. In such a case where the sealing element 21 forms a torque pin, the sealing element 21 is also called a fixed point of the electromechanical actuator 11.

The sealing element 21 of the electromechanical actuator 11 comprises a housing 22.

In the case where the sealing element 21 and the torque support of the electromechanical actuator 11 are two separate parts, the torque support comprises a passage opening for the power cable 18 arranged opposite the housing 22 of the sealing element 21.

The sealing element 21 is positioned at one end of the electromechanical actuator 11 opposite that comprising the output shaft 20.

Here, the sealing element 21 is made from plastic.

The electronic control unit 15 is electrically connected to a first electrical connector 23.

The first electrical connector 23 is arranged opposite the housing 22 of the sealing element 21 or at least partially inside the housing 22 of the sealing element 21.

The first electrical connector 23 is electrically connected to the electric motor 16 of the electromechanical actuator 11.

In one embodiment, the first electrical connector 23 is arranged inside the casing 17 of the electromechanical actuator 11, and in particular arranged between the sealing element 21 and the electric motor 16. Thus, the first electrical connector 23 is arranged completely outside the housing 22 of the sealing element 21.

In another embodiment, a first part of the first electrical connector 23 is arranged inside the housing 22 of the sealing element 21, and a second part of the first electrical connector 23 is arranged inside the casing 17 of the electromechanical actuator 11, and in particular arranged between the sealing element 21 and the electric motor 16.

In another embodiment, the first electrical connector 23 is arranged completely inside the housing 22 of the sealing element 21.

The power cable 18 comprises a second electrical connector 24 at one of its ends.

The second electrical connector 24 cooperates with the first electrical connector 23, so as to supply the electric motor 16 of the electromechanical actuator 11 with electricity, using the power cable 18.

Thus, the supply of electricity for the electric motor 16 of the electromechanical actuator 11 is done by coupling the second electrical connector 24 of the power cable 18 with the first electrical connector 23 electrically connected to the electronic control unit 15.

The second electrical connector 24 comprises a body 25. The body 25 of the second electrical connector 24 has an elongate shape and an elliptical or substantially parallelepiped cross-section.

The second electrical connector 24 comprises an elastic tab 26.

Figure 6:
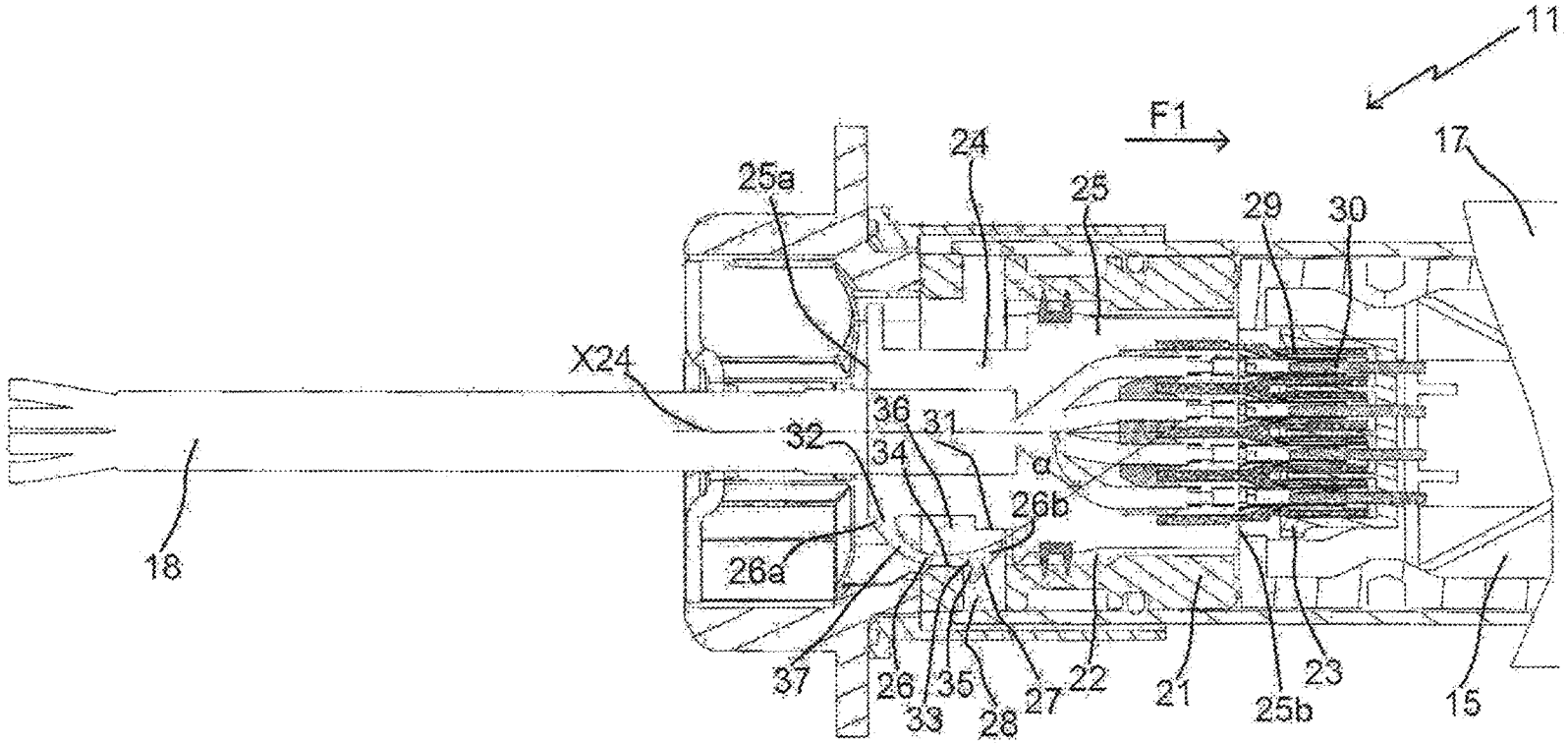
FIG. 6 is a partial diagrammatic sectional view of the electromechanical actuator of FIGS. 4 and 5 in the configuration illustrated in FIG. 4.

In FIG. 6, the body 25 of the second electrical connector 24 and the elastic tab 26 of the second electrical connector 24 are not crosshatched, whereas FIG. 6 is a sectional view, in order to facilitate the reading thereof.

The elastic tab 26 comprises a stop element 27 cooperating with a cavity 28 arranged in the housing 22 of the sealing element 21.

Here and non-limitingly, the cavity 28 is a slit arranged between a front wall of the sealing element 21 and part of a body of the sealing element 21, and extending radially from the peripheral contour of the housing 22 of the sealing element 21 toward the outer side of the sealing element 21.

In an idle position of the elastic tab 26 of the second electrical connector 24, the stop element 27 of the elastic tab 26 of the second electrical connector 24 is configured to cooperate with the cavity 28 arranged in the housing 22 of the sealing element 21.

In this way, the stop element 27 of the elastic tab 26 of the second electrical connector 24 cooperates with a corresponding shape of the cavity 28 arranged in the housing 22 of the sealing element 21 to maintain the second electrical connector 24 relative to the first electrical connector 23 following the coupling of the second electrical connector 24 with the first electrical connector 23.

The cooperation of the stop element 27 of the elastic tab 26 of the second electrical connector 24 with the cavity 28 arranged in the housing 22 of the sealing element 21 prevents the involuntary separation of the second electrical connector 24 of the power cable 18 relative to the first electrical connector 23 electrically connected to the electronic control unit 15.

When the second electrical connector 24 of the power cable 18 is coupled with the first electrical connector 23 electrically connected to the electronic control unit 15, the stop element 27 of the elastic tab 26 of the second electrical connector 24 is inserted, then housed in the cavity 28 arranged in the housing 22 of the sealing element 21.

Here, the body of the first and second electrical connectors 23, 24, as well as the elastic tab 26 of the second electrical connector 24, are made from plastic.

Figure 7:
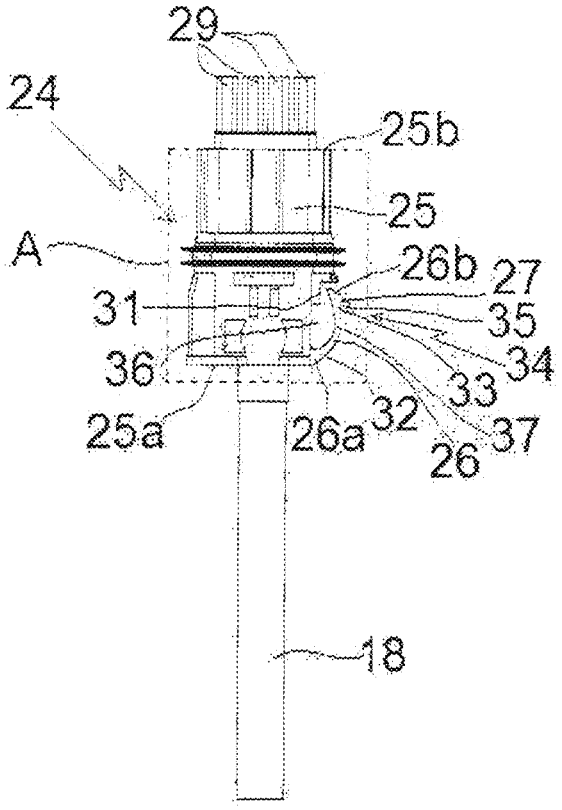
FIG. 7 is a diagrammatic top view of the power cable including a second electrical connector used with an electromechanical actuator illustrated in FIGS. 3 to 6.
Figure 8:
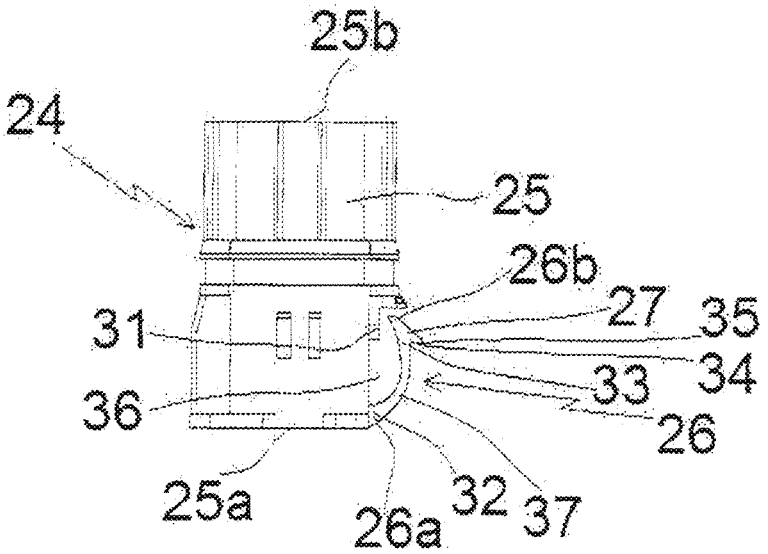
FIG. 8 is a view of detail A of FIG. 7, where the elastic tab of the second electrical connector is in an idle position.

In one embodiment, as illustrated in FIGS. 6 to 8, the second electrical connector 24 of the power cable 18 comprises at least one female element 29 configured to be engaged with a corresponding male element 30 of the first electrical connector 23 electrically connected to the electronic control unit 15.

Here and non-limitingly, the second electrical connector 24 of the power cable 18 comprises four female elements 29 configured to be engaged with four corresponding male elements 30 of the first electrical connector 23 electrically connected to the electronic control unit 15.

Each female element 29 of the second electrical connector 24 is electrically connected to an electrical conductor of the power cable 18. Additionally, each male element 30 of the first electrical connector 23 is electrically connected to the electronic control unit 15 of the electromechanical actuator 11, in particular a printed circuit board.

The engagement of said at least one female element 29 of the second electrical connector 24 of the power cable 18 with the corresponding male element 30 of the first electrical connector 23 electrically connected to the electronic control unit 15 is done in the direction of arrow F1 illustrated in FIG. 6.

Additionally, the disengagement of said at least one female element 29 of the second electrical connector 24 of the power cable 18 with the corresponding male element 30 of the first electrical connector 23 electrically connected to the electronic control unit 15 is done in the opposite direction.

In this way, the power cable 18 of the electromechanical actuator 11 is a so-called pin power cable.

Alternatively, said at least one female element and said at least one male element can be reversed relative to the first and second electrical connectors, i.e., respectively associated with the first electrical connector and the second electrical connector.

The elastic tab 26 also comprises a first end 26*a* connected to the body 25 of the second electrical connector 24.

The first end 26*a* of the elastic tab 26 is connected to a first end 25*a* of the body 25 of the second electrical connector 24.

The first end 25*a* of the body 25 of the second electrical connector 24 corresponds to the insertion end of the electrical conductors of the power cable 18 in the second electrical connector 24.

The elastic tab 26 comprises a first flexure zone 32 arranged at the junction between the first end 26*a* of the elastic tab 26 of the second electrical connector 24 and the body 25 of the second electrical connector 24.

The first flexure zone 32 of the elastic tab 26 corresponds to a flexure zone arranged at a section of an arm 37 of the elastic tab 26 of the second electrical connector 24. This section of the arm 37 of the elastic tab 26 of the second electrical connector 24 is situated near the junction between the first end 26*a* of the elastic tab 26 of the second electrical connector 24 and the body 25 of the second electrical connector 24.

Here, the first flexure zone 32 of the elastic tab 26 is arranged near the junction of the first end 26*a* of the arm 37 of the elastic tab 26 of the second electrical connector 24 with the body 25 of the second electrical connector 24.

Advantageously, the first flexure zone 32 of the elastic tab 26 is arranged in a first third of the length of the elastic tab 26 of the second electrical connector 24, from the junction between the first end 26*a* of the elastic tab 26 of the second electrical connector 24 and the body 25 of the second electrical connector 24.

The stop element 27 of the elastic tab 26 of the second electrical connector 24 is arranged at a second free end 26*b* of the elastic tab 26 of the second electrical connector 24.

The elastic tab 26 of the second electrical connector 24 comprises a second flexure zone 33 arranged at the junction between the arm 37 of the elastic tab 26 of the second electrical connector 24 and the stop element 27 of the elastic tab 26 of the second electrical connector 24.

Thus, the elastic tab 26 of the second electrical connector 24 has two flexure zones 32, 33 respectively arranged at the junction between the first end 26*a* of the elastic tab 26 of the second electrical connector 24 and the body 25 of the second electrical connector 24 and at the junction between the arm 37 of the elastic tab 26 of the second electrical connector 24 and the stop element 27 of the elastic tab 26 of the second electrical connector 24.

In this way, the elastic tab 26 of the second electrical connector 24 makes it possible to improve the keeping up of the first and second electrical connectors 23, 24 when a pulling out force is exerted on the power cable 18 or on the second electrical connector 24. This is obtained through the elastic deformation of the elastic tab 26, in particular via the second flexure zone 33 arranged at the junction between the arm 37 of the elastic tab 26 of the second electrical connector 24 and the stop element 27 of the elastic tab 26 of the second electrical connector 24.

Furthermore, the positioning of the stop element 27 of the elastic tab 26 of the second electrical connector 24 inside the housing 22 of the sealing element 21 makes it possible to limit the accessibility of the free end 26*b* of the elastic tab 26 of the second electrical connector 24 belonging to the power cable 18, so as to avoid an accidental release of the second electrical connector 24 relative to the first electrical connector 23.

Preferably, the second electrical connector 24 comprises a single elastic tab 26.

Thus, during the application of a pulling out force on the power cable 18 or on the second electrical connector 24, the keeping up of the second electrical connector 24 relative to the first electrical connector 23 is improved by limiting the operating play between the second electrical connector 24 and the housing 22 of the sealing element 21, and while guaranteeing the bearing of the stop element 27 of the elastic tab 26 of the second electrical connector 24 against the cavity 28 arranged in the housing 22 of the sealing element 21.

Furthermore, the use of the single elastic tab 26 of the second electrical connector 24 to maintain the second electrical connector 24 in place relative to the first electrical connector 23 makes it possible to reduce the bulk of the second electrical connector 24, and consequently of the housing 22 of the sealing element 21.

Furthermore, the use of the single elastic tab 26 of the second electrical connector 24 makes it possible to mistake-proof the assembly direction of the second electrical connector 24 of the power cable 18 relative to the first electrical connector 23 electrically connected to the electronic control unit 15.

Here, the elastic tab 26 of the second electrical connector 24 is arranged at a recess 36 formed in the body 25 of the second electrical connector 24.

Preferably, the elastic tab 26 of the second electrical connector 24 extends along the body 25 of the second electrical connector 24 from the first end 25*a* of the body 25 of the second electrical connector 24 toward the second end 25*b* of the body 25 of the second electrical connector 24.

The second end 25*b* of the body 25 of the second electrical connector 24 corresponds to the end cooperating with the first electrical connector 23.

Thus, the arrangement of the elastic tab 26 of the second electrical connector 24 extends along the body 25 of the second electrical connector 24, from the first end 25*a* of the body 25 toward the second end 25*b* of the body 25 of the second electrical connector 24, makes it possible to limit the accessibility of the free end 26*b* of the elastic tab 26 of the second electrical connector 24 belonging to the power cable 18 following the coupling of the second electrical connector 24 with the first electrical connector 23 electrically connected to the electronic control unit 15.

Advantageously, the free end 26*b* of the elastic tab 26 of the second electrical connector 24 extends along a planar side wall 31 of the body 25 of the second electrical connector 24, so as to place the free end 26*b* of the elastic tab 26 of the second electrical connector 24 bearing against the planar side wall 31 of the body 25 of the second electrical connector 24 during application of a pulling out force on the power cable 18 or on the second electrical connector 24.

Thus, during the application of a pulling out force on the power cable 18 or on the second electrical connector 24, the keeping up of the second electrical connector 24 relative to the first electrical connector 23 is guaranteed on the one hand by the elastic deformation of the elastic tab 26, in particular via the second flexure zone 33 arranged at the junction between the arm 37 of the elastic tab 26 of the second electrical connector 24 and the stop element 27 of the elastic tab 26 of the second electrical connector 24, and on the other hand by the bearing of the stop element 27 of the elastic tab 26 of the second electrical connector 24 against the planar side wall 31 of the body 25 of the second electrical connector 24.

In this way, the bearing of the stop element 27 of the elastic tab 26 of the second electrical connector 24 against the planar side wall 31 of the body 25 of the second electrical connector 24 makes it possible to lock the position of the second electrical connector 24 regarding to the first electrical connector 23 during the application of a pulling out force on the power cable 18 or on the second electrical connector 24.

Advantageously, the junction between the first end 26*a* of the elastic tab 26 of the second electrical connector 24 and the body 25 of the second electrical connector 24 undergoes bending at the first flexure zone 32 during the separation of the second electrical connector 24 from the first electrical connector 23.

Thus, the separation of the second electrical connector 24 relative to the first electrical connector 23 is done by exerting pressure on the elastic tab 26 of the second electrical connector 24 causing bending of the first flexure zone 32 arranged at the junction between the first end 26*a* of the elastic tab 26 of the second electrical connector 24 and the body 25 of the second electrical connector 24.

In this way, the bending of the first flexure zone 32 makes it possible to disengage the stop element 27 of the elastic tab 26 of the second electrical connector 24 relative to the cavity 28 arranged in the housing 22 of the sealing element 21.

Preferably, the bending at the first flexure zone 32, during the removal of the second electrical connector 24 from the first electrical connector 23, is done using a tool T.

Thus, the separation of the second electrical connector 24 relative to the first electrical connector 23 is done by exerting pressure on the elastic tab 26 of the second electrical connector 24 using a tool T, in particular a screwdriver.

During the separation of the second electrical connector 24 relative to the first electrical connector 23, the junction between the arm 37 of the elastic tab 26 of the second electrical connector 24 and the stop element 27 of the elastic tab 26 of the second electrical connector 24 can also undergo bending at the second flexure zone 33, in particular during the insertion of a tool T between the arm 37 of the elastic tab 26 of the second electrical connector 24 and the peripheral contour of the housing 22 of the sealing element 21 and/or during the disengagement of the stop element 27 of the elastic tab 26 of the second electrical connector 24 relative to the cavity 28 arranged in the housing 22 of the sealing element 21 using a tool T.

Practically, the elastic tab 26 of the second electrical connector 24 has a bearing zone 34, so as to allow it to bend at the first flexure zone 32.

Thus, the bearing zone 34 arranged on the elastic tab 26 makes it possible to move the elastic tab 26 toward the body 25 of the second electrical connector 24, and in particular toward the second end 25*b* of the body 25 of the second electrical connector 24, so as to disengage the stop element 27 of the elastic tab 26 of the second electrical connector 24 relative to the cavity 28 arranged in the housing 22 of the sealing element 21.

In this way, the separation of the second electrical connector 24 relative to the first electrical connector 23 is done by exerting pressure on the elastic tab 26 of the second electrical connector 24 toward the body 25 of the second electrical connector 24, and in particular toward the planar side wall 31 of the body 25 of the second electrical connector 24.

The bearing zone 34 of the elastic tab 26 of the second electrical connector 24 can be arranged on part of the arm 37 of the elastic tab 26, or on a rear face 35 of the stop element 27 of the elastic tab 26, or at the junction between the stop element 27 of the elastic tab 26 and the arm 37 of the elastic tab 26.

The stop element 27 of the elastic tab 26 of the second electrical connector 24 can thus be moved toward the body 25 of the second electrical connector 24, and in particular toward the planar side wall 31 of the body 25 of the second electrical connector 24, so as to be released from the cavity 28 arranged in the housing 22 of the sealing element 21.

In this way, the second electrical connector 24 can be separated relative to the first electrical connector 23 by removing the second electrical connector 24 toward the outside of the electromechanical actuator 11, and in particular in the opposite direction relative to arrow F1 shown in FIG. 6.

Figure 9:
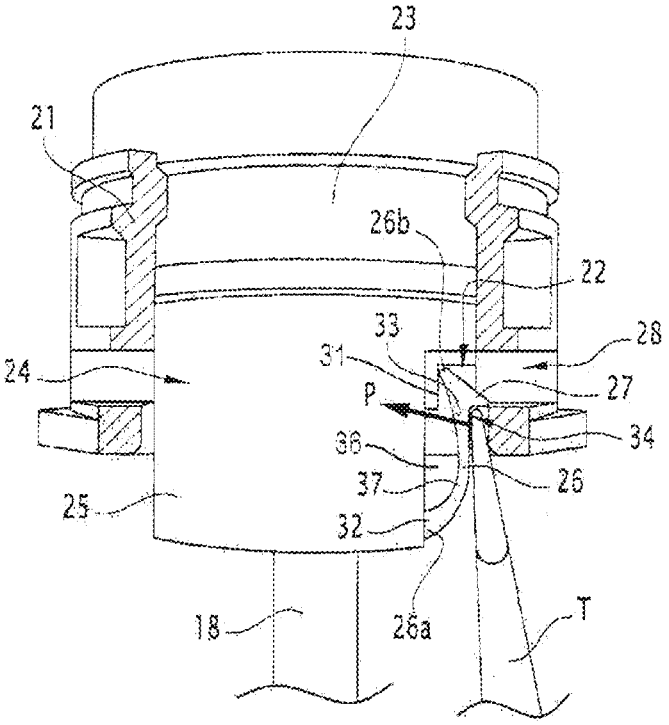
FIG. 9 is a diagrammatic side view including a cutaway zone and illustrating the case where the elastic tab of the second electrical connector is in a position for the separation of the second electrical connector from the first electrical connector.

Furthermore, the separation of the second electrical connector 24 relative to the first electrical connector 23 is done by exerting pressure P on the elastic tab 26 of the second electrical connector 24 using a tool, in particular a screwdriver T, as shown in FIG. 9, where FIG. 9 shows a cutaway zone to make it possible to view the housing 22, the first and second electrical connectors 23, 24 and the cavity 28. The need to use the screwdriver T to exert the pressure P makes it possible to prevent the accidental release of the second electrical connector 24 of the power cable 18 relative to the first electrical connector 23 electrically connected to the electronic control unit 15, while limiting the accessibility of the bearing zone 34 on the elastic tab 26 of the second electrical connector 24.

In this way, the positioning of the elastic tab 26, the second electrical connector 24 at least partially inside the housing 22 of the sealing element 21 limits the access to the bearing zone 34 on the elastic tab 26, this access only being able to be obtained using an elongated tool, in particular the screwdriver T, so as to allow bending of the first flexure zone 32 arranged at the junction between the first end 26*a* of the elastic tab 26 of the second electrical connector 24 and the body 25 of the second electrical connector 24.

Consequently, the bearing zone 34 on the elastic tab 26 allowing bending of the first flexure zone 32 arranged at the junction between the first end 26*a* of the elastic tab 26 of the second electrical connector 24 and the body 25 of the second electrical connector 24, cannot be reached easily by the user's fingers.

Here, the elastic tab 26 of the second electrical connector 24 is arc of circle-shaped.

Thus, the arc of circle shape of the elastic tab 26 of the second electrical connector 24 makes it possible to connect the first flexure zone 32 to the second flexure zone 33 using a single arm 37.

Furthermore, the arc of circle shape of the elastic tab 26 of the second electrical connector 24 makes it possible to facilitate the insertion of a tool T between the arm 37 of the elastic tab 26 of the second electrical connector 24 and the peripheral contour of the housing 22 of the sealing element 21.

Furthermore, the junction between the first end 26*a* of the elastic tab 26 of the second electrical connector 24 and the body 25 of the second electrical connector 24 undergoes bending at the first flexure zone 32 during the coupling of the second electrical connector 24 of the power cable 18 with the first electrical connector 23 electrically connected to the electronic control unit 15.

Advantageously, the arm 37 of the elastic tab 26 of the second electrical connector 24 is flexible.

Thus, the arm 37 of the elastic tab 26 of the second electrical connector 24 can be deformed during the separation of the second electrical connector 24 relative to the first electrical connector 23 done by exerting pressure on the elastic tab 26 of the second electrical connector 24 toward the body 25 of the second electrical connector 24, and in particular using a tool T.

Preferably, the junction between the arm 37 of the elastic tab 26 of the second electrical connector 24 and the stop element 27 of the elastic tab 26 of the second electrical connector 24 undergoes bending at the second flexure zone 33 during the application of a pulling out force on the power cable 18 or on the second electrical connector 24.

Thus, during the application of a pulling out force on the power cable 18 or on the second electrical connector 24, the keeping up of the second electrical connector 24 relative to the first electrical connector 23 results in pressure on the stop element 27 of the elastic tab 26 of the second electrical connector 24 bearing against the cavity 28 arranged in the housing 22 of the sealing element 21.

The pressure exerted on the stop element 27 of the elastic tab 26 of the second electrical connector 24 causes bending of the second flexure zone 33 arranged at the junction between the arm 37 of the elastic tab 26 of the second electrical connector 24 and the stop element 27 of the elastic tab 26 of the second electrical connector 24.

In this way, the bending of the second flexure zone 33 makes it possible to lock the stop element 27 of the elastic tab 26 of the second electrical connector 24 against the cavity 28 arranged in the housing 22 of the sealing element 21.

The application of a pulling out force on the power cable 18 or on the second electrical connector 24 only occurs when the second electrical connector 24 is coupled with the first electrical connector 23, i.e., the stop element 27 of the elastic tab 26 of the second electrical connector 24 cooperates with the cavity 28 arranged in the housing 22 of the sealing element 21.

Furthermore, when a pulling out force is exerted on the power cable 18 or on the second electrical connector 24, the keeping up of the second electrical connector 24 relative to the first electrical connector 23 is also guaranteed by the bearing of the stop element 27 of the elastic tab 26 of the second electrical connector 24 against the planar side wall 31 of the body 25 of the second electrical connector 24.

When a pulling out force is exerted on the power cable 18 or on the second electrical connector 24, the junction between the first end 26*a* of the elastic tab 26 of the second electrical connector 24 and the body 25 of the second electrical connector 24 can also undergo bending at the first flexion zone 32, in particular when a pulling out force is exerted on the power cable 18 or on the second electrical connector 24 along a direction that is inclined or perpendicular relative to a longitudinal axis passing through the second electrical connector 24.

Advantageously, the stop element 27 of the elastic tab 26 of the second electrical connector 24 is harpoon-shaped.

Thus, the stop element 27 of the elastic tab 26 of the second electrical connector 24 has an arrow-shaped tip, the tip having a single curved part, and the tip being arranged at a second free end 26*b* of the elastic tab 26 of the second electrical connector 24.

Advantageously, the second free end 26*b* of the elastic tab 26 of the second electrical connector 24 is oriented toward the body 25 of the second electrical connector 24, and in particular toward the planar side wall 31 of the body 25 of the second electrical connector 24.

Thus, when a pulling out force is exerted on the power cable 18 or on the second electrical connector 24, the force transmitted by the stop element 27 of the elastic tab 26 of the second electrical connector 24 against the cavity 28 arranged in the housing 22 of the sealing element 21 is along a direction inclined by an angle $\alpha$ relative to the longitudinal axis X24 passing through the second electrical connector 24.

Furthermore, when a pulling out force is exerted on the power cable 18 or on the second electrical connector 24, the force transmitted by the stop element 27 of the elastic tab 26 of the second electrical connector 24 against the planar side wall 31 of the body 25 of the second electrical connector 24 is along a direction inclined by a same angle $\alpha$ relative to the longitudinal axis X24 passing through the second electrical connector 24.

Owing to the present invention, the elastic tab of the second electrical connector has two flexure zones respectively arranged at the junction between the first end of the elastic tab of the second electrical connector and the body of the second electrical connector and at the junction between the arm of the elastic tab of the second electrical connector and the stop element of the elastic tab of the second electrical connector.

In this way, the elastic tab of the second electrical connector makes it possible to improve the keeping up of the first and second electrical connectors when a pulling out force is exerted on the power cable or on the second electrical connector. This is obtained through the elastic deformation of the elastic tab, in particular via the second flexure zone arranged at the junction between the arm of the elastic tab of the second electrical connector and the stop element of the elastic tab of the second electrical connector.

Furthermore, the positioning of the stop element of the elastic tab of the second electrical connector inside the housing of the sealing element makes it possible to limit the accessibility of the free end of the elastic tab of the second electrical connector belonging to the power cable, so as to avoid an accidental release of the second electrical connector relative to the first electrical connector.

Many changes can be made to the example embodiment previously described without going beyond the scope of the invention.

The invention claimed is:

1. An electromechanical actuator for a closure or sun protection home automation installation, the actuator comprising:

a casing;

an electric motor;

a sealing element for one end of the casing;

a power cable; and an electronic control unit positioned inside the casing and electrically connected to a first electrical connector, wherein the sealing element comprises a housing, the first electrical connector being disposed opposite the housing of the sealing element or at least partially inside the housing of the sealing element, wherein the power cable comprises, at one end thereof, a second electrical connector, the second electrical connector engaging the first electrical connector, to supply the electric motor with electricity, the second electrical connector comprising an elastic tab, said elastic tab comprising:

a stop element cooperating with a cavity disposed in the housing of the sealing element, the stop element of the elastic tab of the second electrical connector being disposed at a free end of the elastic tab of the second electrical connector, a first end connected to a body of the second electrical connector, a first flexure zone disposed at the junction between the first end of the elastic tab of the second electrical connector and the body of the second electrical connector, and a second flexure zone disposed at the junction between an arm of the elastic tab of the second electrical connector and the stop element of the elastic tab of the second electrical connector, the second flexure zone being configured to bend during application of a pulling out force on the power cable or on the second electrical connector, wherein the elastic tab is configured such that during application of the pulling out force on the power cable or on the second electrical connector, maintaining the second electrical connector in the engaged position with the first electrical connector results in pressure on the stop element of the elastic tab of the second electrical connector bearing against a cavity disposed in the housing of the sealing element, and when the pulling out force is exerted on the power cable or on the second electrical connector, the second electrical connector is maintained in the engaged position with the first electrical connector by bearing of the stop element of the elastic tab of the second electrical connector against a planar side wall of the body of the second electrical connector.

2. The electromechanical actuator for a closure or sun protection home automation installation according to claim 1, wherein the junction between the first end of the elastic tab of the second electrical connector and the body of the second electrical connector undergoes bending at the first flexure zone during separation of the second electrical connector from the first electrical connector.

3. The electromechanical actuator for a closure or sun protection home automation installation according to claim 2, wherein the elastic tab of the second electrical connector is configured so that the bending at the first flexure zone, during the removal of the second electrical connector from the first electrical connector, is adapted to be done using a tool.

4. The electromechanical actuator for a closure or sun protection home automation installation according to claim 1, wherein the elastic tab of the second electrical connector has a bearing zone, so as to allow it to bend at the first flexure zone.

5. The electromechanical actuator for a closure or sun protection home automation installation according to claim 1, wherein the free end of the elastic tab of the second electrical connector extends along the planar side wall of the body of the second electrical connector, to place the free end of the elastic tab of the second electrical connector bearing against the planar side wall of the body of the second electrical connector during application of the pulling out force on the power cable or on the second electrical connector.

6. The electromechanical actuator for a closure or sun protection home automation installation according to claim 1, wherein the stop element of the elastic tab of the second electrical connector is harpoon-shaped.

7. The electromechanical actuator for a closure or sun protection home automation installation according to claim 1, wherein the second electrical connector comprises a single elastic tab.

8. The electromechanical actuator for a closure or sun protection home automation installation according to claim 1, wherein the elastic tab of the second electrical connector extends along the body of the second electrical connector from the first end of the body of the second electrical connector toward the second end of the body of the second electrical connector, where the first end of the body of the second electrical connector corresponds to the insertion end of electrical conductors of the power cable in the second electrical connector, and where the second end of the body of the second electrical connector corresponds to the end cooperating with the first electrical connector.

9. The electromechanical actuator for a closure or sun protection home automation installation according to claim 1, wherein the elastic tab of the second electrical connector is arc of circle-shaped.

10. A closure or sun protection home automation installation comprising:

a screen configured to be wound on a winding tube rotated by the electromechanical actuator according to claim 1, wherein the electromechanical actuator is received at least partially in the winding tube.

11. The electromechanical actuator for a closure or sun protection home automation installation according to claim 1, wherein when the pulling out force is exerted on the power cable or on the second electrical connector, a junction between the first end of the elastic tab of the second electrical connector and the body of the second electrical connector undergoes bending at the first flexure zone.

* * * * *